US006527415B1

(12) United States Patent
Scimone

(10) Patent No.: US 6,527,415 B1
(45) Date of Patent: Mar. 4, 2003

(54) CHANGE SAVER LAMP APPARATUS

(76) Inventor: Michael Scimone, 1140 67th St., Brooklyn, NY (US) 11219

( * ) Notice: Subject to any disclaimer, the term of this patent is extended or adjusted under 35 U.S.C. 154(b) by 0 days.

(21) Appl. No.: 09/675,168

(22) Filed: Sep. 29, 2000

(51) Int. Cl.[7] ..... F21V 33/00
(52) U.S. Cl. ..... 362/253; 362/101
(58) Field of Search ..... 362/801, 806, 362/253, 101; D26/851, 56

(56) References Cited

U.S. PATENT DOCUMENTS

| | | | | | |
|---|---|---|---|---|---|
| D204,795 | S | | 5/1966 | Dickerson | |
| 4,504,893 | A | * | 3/1985 | Bostick, Sr. | 362/253 |
| D293,028 | S | | 12/1987 | Yother et al. | |
| 5,067,060 | A | * | 11/1991 | Sieracki | 362/101 |
| D345,924 | S | | 4/1994 | Clincy | |
| D370,547 | S | | 6/1996 | Moss | |
| D381,838 | S | | 8/1997 | Stenzel | |
| 5,980,056 | A | * | 11/1999 | West | 362/86 |
| 6,048,078 | A | * | 4/2000 | Wang | 362/253 |
| 6,174,072 | B1 | * | 1/2001 | Root, Jr. | 362/190 |
| 6,236,622 | B1 | * | 5/2001 | Blackman | 368/10 |
| 6,238,061 | B1 | * | 5/2001 | Mckenzie et al. | 362/253 |

* cited by examiner

*Primary Examiner*—Sandra O'Shea
*Assistant Examiner*—Jacob Y. Choi

(57) ABSTRACT

A change saver lamp apparatus for providing a unique novelty coin bank and lamp arrangement. The change saver lamp apparatus includes a base assembly including a base member; and also includes a change-storing assembly including a plurality of elongate change-storing members each having a top end and a bottom end which is removably and securely disposed in the base member; and further includes at least one elongate support member having a top end and a bottom end which is securely disposed in the base member; and also includes a light-emitting assembly including at least one light socket assembly and also including at least one light-emitting member being removably disposed in the at least one light socket assembly.

13 Claims, 4 Drawing Sheets

CHANGE SAVER LAMP APPARATUS

BACKGROUND OF THE INVENTION

1. Field of the Invention

The present invention relates to a light change saver and more particularly pertains to a new change saver lamp apparatus for providing a unique novelty coin bank and lamp arrangement.

2. Description of the Prior Art

The use of a light change saver is known in the prior art. More specifically, a light change saver heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,504,893; Des. 293,028; Des. 381,838; Des. 204,795; Des. 345,924; and Des. 370,547.

While these devices fulfill their respective, particular objectives and requirements, the aforementioned patents do not disclose a new change saver lamp apparatus. The inventive device includes a base assembly including a base member; and also includes a change-storing assembly including a plurality of elongate change-storing members each having a top end and a bottom end which is removably and securely disposed in the base member; and further includes at least one elongate support member having a top end and a bottom end which is securely disposed in the base member; and also includes a light-emitting assembly including at least one light socket assembly and also including at least one light-emitting member being removably disposed in the at least one light socket assembly.

In these respects, the change saver lamp apparatus according to the present invention substantially departs from the conventional concepts and designs of the prior art, and in so doing provides an apparatus primarily developed for the purpose of providing a unique novelty coin bank and lamp arrangement.

SUMMARY OF THE INVENTION

In view of the foregoing disadvantages inherent in the known types of light change saver now present in the prior art, the present invention provides a new change saver lamp apparatus construction wherein the same can be utilized for providing a unique novelty coin bank and lamp arrangement.

The general purpose of the present invention, which will be described subsequently in greater detail, is to provide a new change saver lamp apparatus which has many of the advantages of the light change saver mentioned heretofore and many novel features that result in a new change saver lamp apparatus which is not anticipated, rendered obvious, suggested, or even implied by any of the prior art light change saver, either alone or in any combination thereof.

To attain this, the present invention generally comprises a base assembly including a base member; and also includes a change-storing assembly including a plurality of elongate change-storing members each having a top end and a bottom end which is removably and securely disposed in the base member; and further includes at least one elongate support member having a top end and a bottom end which is securely disposed in the base member; and also includes a light-emitting assembly including at least one light socket assembly and also including at least one light-emitting member being removably disposed in the at least one light socket assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new change saver lamp apparatus which has many of the advantages of the light change saver mentioned heretofore and many novel features that result in a new change saver lamp apparatus which is not anticipated, rendered obvious, suggested, or even implied by any of the prior art light change saver, either alone or in any combination thereof.

It is another object of the present invention to provide a new change saver lamp apparatus which may be easily and efficiently manufactured and marketed.

It is a further object of the present invention to provide a new change saver lamp apparatus which is of a durable and reliable construction.

An even further object of the present invention is to provide a new change saver lamp apparatus which is susceptible of a low cost of manufacture with regard to both materials and labor, and which accordingly is then susceptible of low prices of sale to the consuming public, thereby making such change saver lamp apparatus economically available to the buying public.

Still yet another object of the present invention is to provide a new change saver lamp apparatus which provides in the apparatuses and methods of the prior art some of the advantages thereof, while simultaneously overcoming some of the disadvantages normally associated therewith.

Still another object of the present invention is to provide a new change saver lamp apparatus for providing a unique novelty coin bank and lamp arrangement.

Yet another object of the present invention is to provide a new change saver lamp apparatus which includes a base assembly including a base member; and also includes a change-storing assembly including a plurality of elongate change-storing members each having a top end and a bottom end which is removably and securely disposed in the base member; and further includes at least one elongate support member having a top end and a bottom end which is securely disposed in the base member; and also includes a light-emitting assembly including at least one light socket assembly and also including at least one light-emitting member being removably disposed in the at least one light socket assembly.

Still yet another object of the present invention is to provide a new change saver lamp apparatus that would be an attractive piece of furniture in a home or office.

Even still another object of the present invention is to provide a new change saver lamp apparatus that would encourage people to save money especially their coins.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
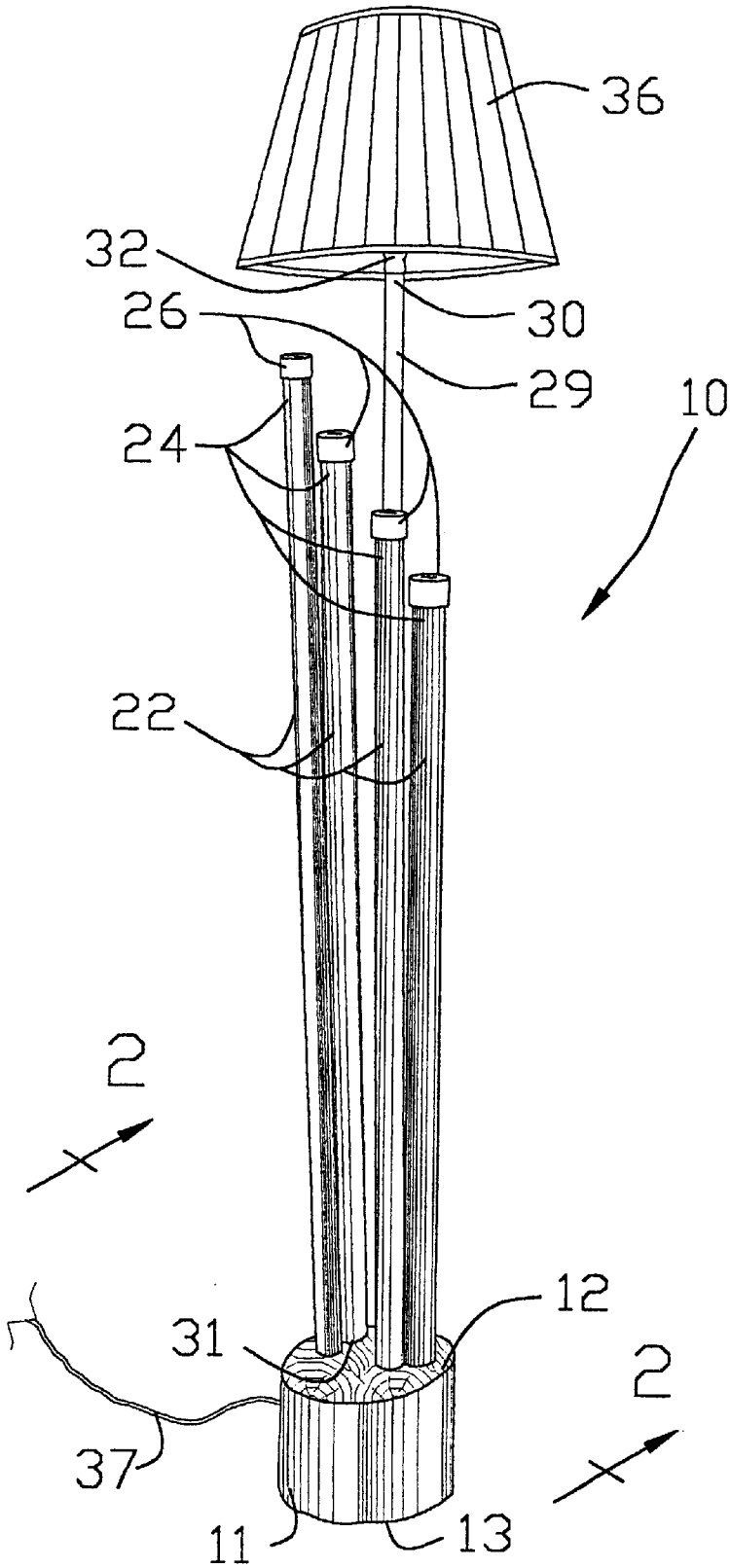
FIG. 1 is a perspective view of a new change saver lamp apparatus according to the present invention.
Figure 3:
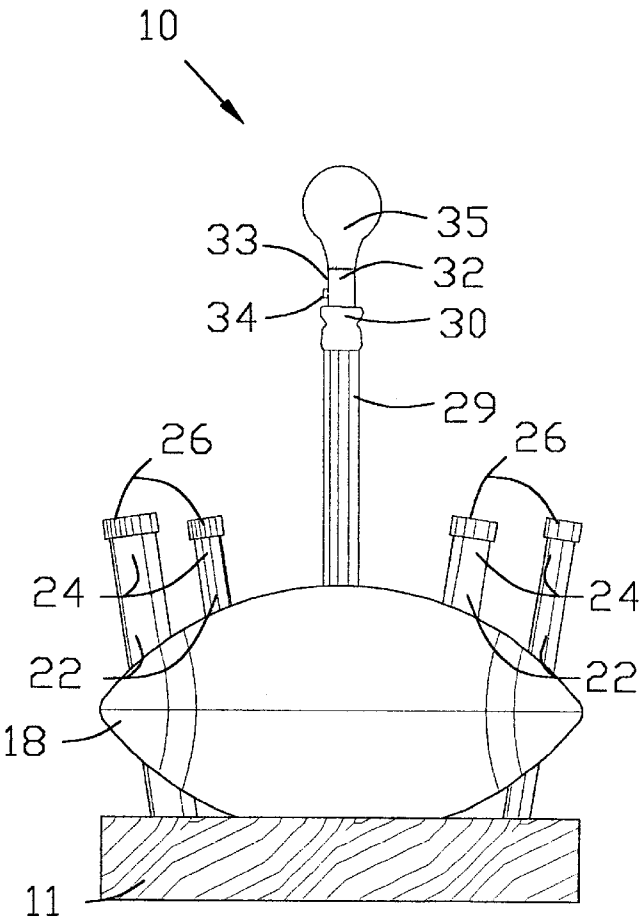
FIG. 3 is a side elevational view of a second embodiment of the present invention.
Figure 2:
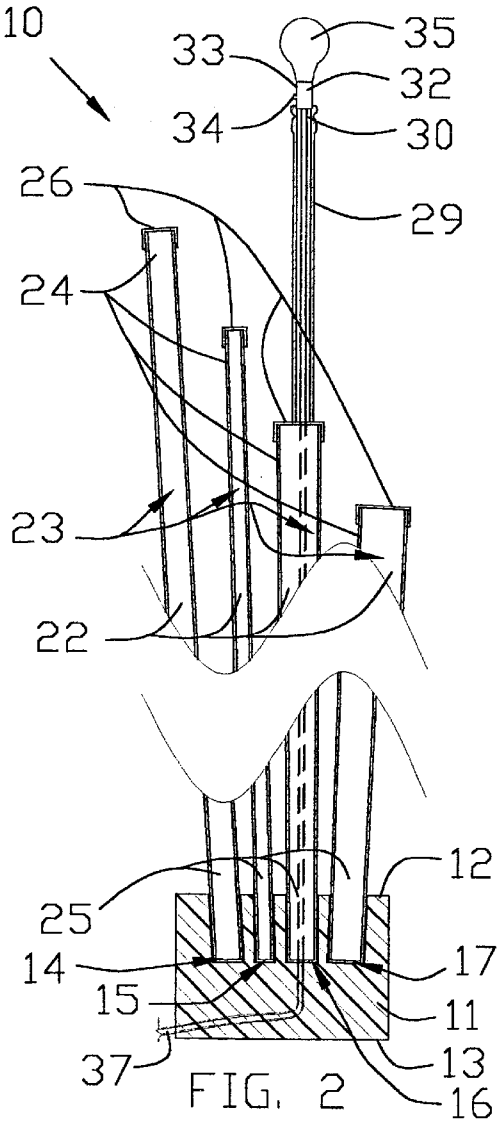
FIG. 2 is a cross-sectional view of the present invention taken along line 2—2 of FIG. 1.
Figure 7:
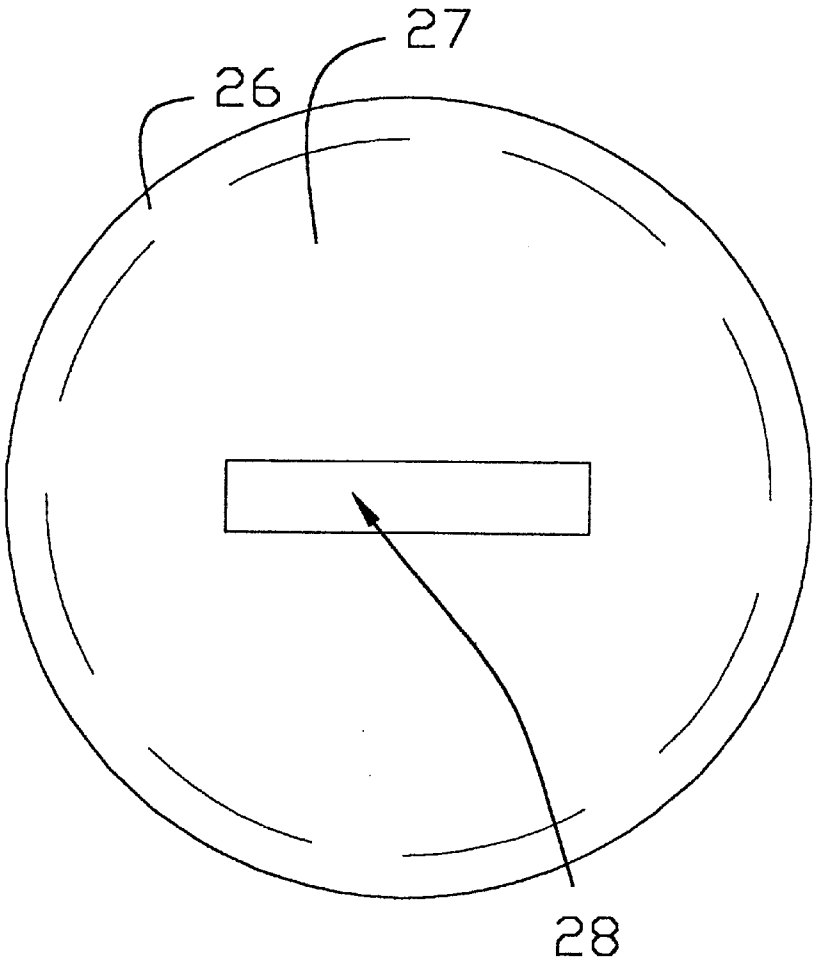
FIG. 7 is a top plan view of one of the change-storing members of the present invention taken from the perspective of arrow 7 of FIG. 6.
Figure 4:
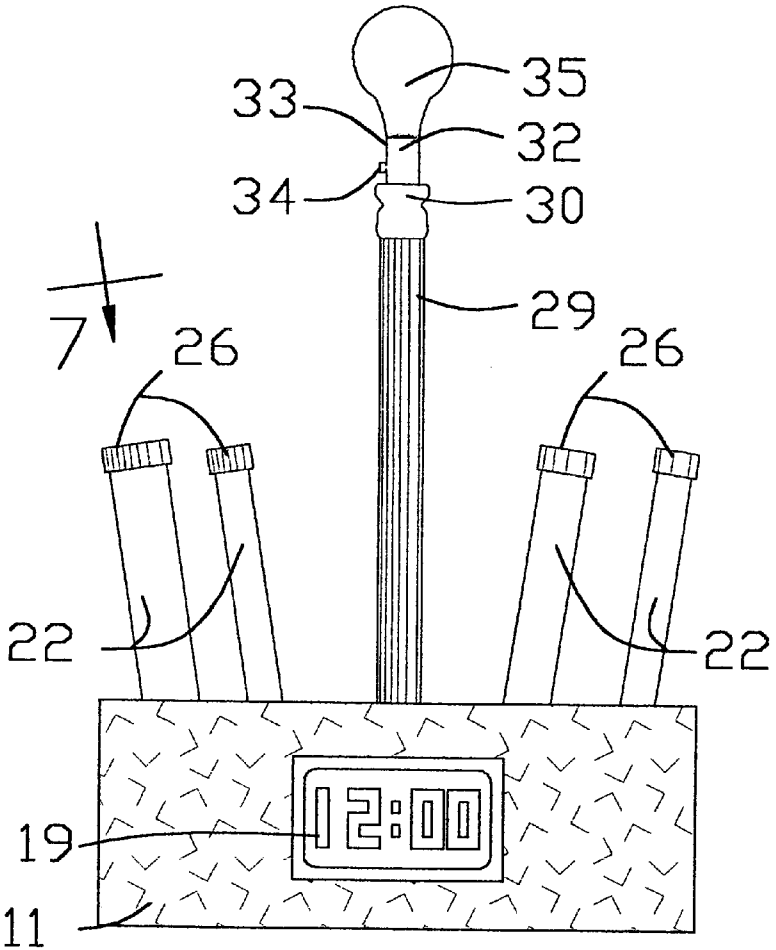
FIG. 4 is a side elevational view of a third embodiment of the present invention.
Figure 5:
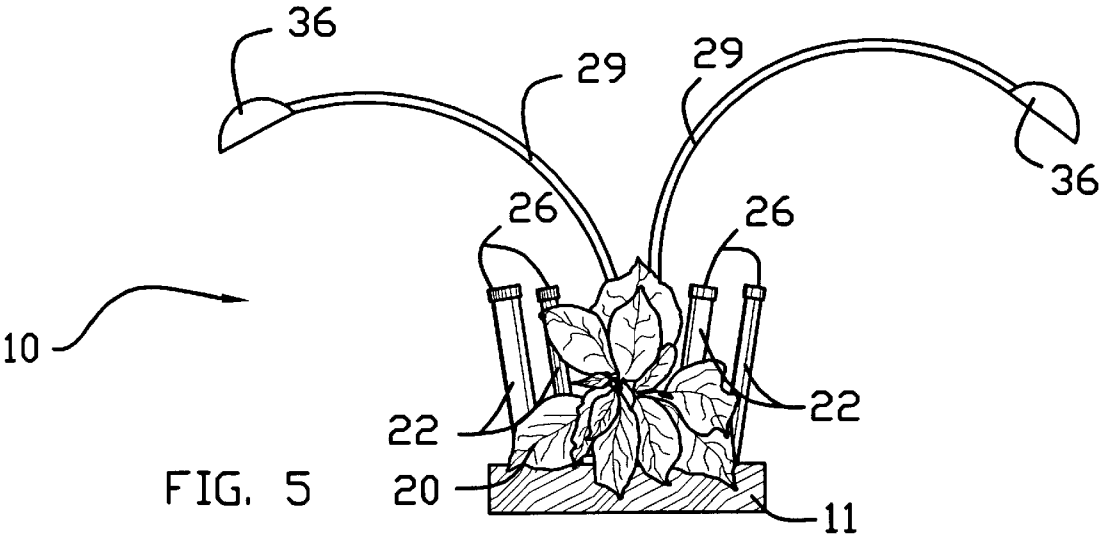
FIG. 5 is a side elevational view of a fourth embodiment of the present invention.
Figure 6:
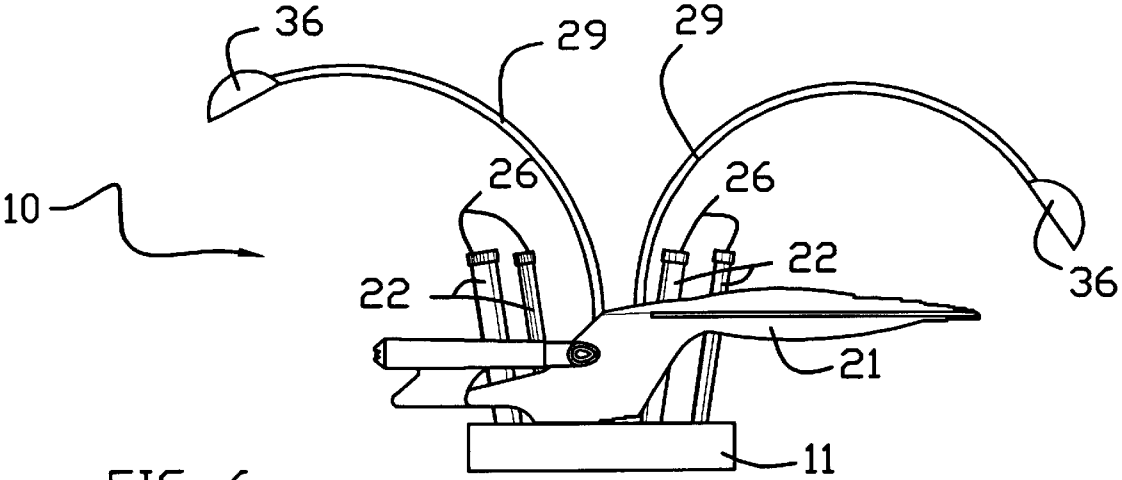
FIG. 6 is a side elevational view of a fifth embodiment of the present invention.

With reference now to the drawings, and in particular to FIGS. 1 through 7 thereof, a new change saver lamp apparatus embodying the principles and concepts of the present invention and generally designated by the reference numeral 10 will be described.

As best illustrated in FIGS. 1 through 7, the change saver lamp apparatus 10 generally comprises a base assembly including a base member 11 having a top side 12, a bottom side 13, and a plurality of slots 14–17 disposed in the top side 12 thereof. The base assembly also includes an ornamental structure 18–21 being securely and conventionally attached to the base member 11 and including a football-shaped structure 18, a clock 19, a flowers-shaped structure 20, and a space ship structure 21;

A change-storing assembly includes a plurality of elongate change-storing members 22 each having a top end 24 and a bottom end 25 which is removably and securely disposed in the base member 11. Each of the elongate change-storing members 22 is a tubular member 22 having a storage compartment 23 therein. The storage compartment 23 is adapted to store change such as coins and paper money. The tubular members 22 are angled upwardly from the base member 11. The change-storing assembly also includes a plurality of lids 26 being removably disposed upon the top ends 24 of the tubular members 11. Each of the lids 26 has a main wall 27 and a slot 28 being disposed through the main wall 27 and being adapted to receive the change therethrough. The slots 14–17 in the base member 11 are adapted to receive the bottom ends 25 of the elongate change-storing members 22.

The change saver lamp apparatus 10 also comprises one or more elongate support members 29 each having a top end 30 and a bottom end 31 which is securely and conventionally disposed in the base member 11. The one or more elongate support members 29 extend upwardly from the base member 11.

A light-emitting assembly includes a light socket assembly being conventionally attached to the top end 30 of the one or more elongate support members 29, and also includes one or more light-emitting member 35 being removably disposed in the light socket assembly. The light socket assembly further includes one or more light socket members 32 each having a side wall 33 and also includes one or more on/off switches 34 being movably and securely disposed in the side walls 33 of the one or more light socket members 32. The light-emitting assembly also includes a power cord 37 being conventionally connected to the one or more light socket members 32 for energizing the one or more light-emitting member 35. The power cord 37 is disposed through the one or more elongate support members 29. The light-emitting assembly further includes one or more light shade members 36 being removably and conventionally disposed upon the one or more light socket members 32.

In use, the user uses the change saver lamp apparatus 10 just like any lamp except the user can store one's change including coins in the tubular members 22 by simply inserting the change through the slots 28 in the lids 26.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A change saver lamp apparatus comprising:

a base assembly including a base member;

a change-storing assembly including a plurality of elongate change-storing members each having a top end and a bottom end which is removably and securely disposed in said base member;

at least one elongate support member having a top end and a bottom end which is securely disposed in said base member, said at least one elongate support member extending upwardly from said base member; and a light-emitting assembly including a light socket assembly being attached to said top end of said at least one elongate support member, and also including at least one light-emitting member being removably disposed in said light socket assembly;

wherein said change-storing assembly also includes a plurality of lids being removably disposed upon said top ends of said elongate change-storing members, each of said lids having a main wall and a slot being disposed through said main wall and being adapted to receive change therethrough.

2. A change saver lamp apparatus as described in claim 1, wherein said base member has a top side, a bottom side, and a plurality of slots disposed in said top side thereof, said slots being adapted to receive said bottom ends of said elongate change-storing members.

3. A change saver lamp apparatus as described in claim 2, wherein each of said elongate change-storing members is a tubular member having a storage compartment therein, said storage compartment being adapted to store change, each of said tubular members being angled upwardly from said base member.

4. A change saver lamp apparatus comprising:

a base assembly including a base member;

a change-storing assembly including a plurality of elongate change-storing members each having a top end and a bottom end which is removably and securely disposed in said base member;

at least one elongate support member having a top end and a bottom end which is securely disposed in said base member, said at least one elongate support member extending upwardly from said base member; and a light-emitting assembly including a light socket assembly being attached to said top end of said at least one elongate support member, and also including at least one light-emitting member being removably disposed in said light socket assembly;

wherein said base member has a top side, a bottom side, and a plurality of slots disposed in said top side thereof, said slots being adapted to receive said bottom ends of said elongate change-storing members;

wherein each of said elongate change-storing members is a tubular member having a storage compartment therein, said storage compartment being adapted to store change, said tubular member being angled upwardly from said base member; and wherein said change-storing assembly also includes a plurality of lids being removably disposed upon said top ends of said tubular members, each of said lids having a main wall and a slot being disposed through said main wall and being adapted to receive the change therethrough.

5. A change saver lamp apparatus as described in claim 4, wherein said light socket assembly further includes at least one light socket member having a side wall and also includes at least on/off switch being movably and securely disposed in said side wall of said at least one light socket member.

6. A change saver lamp apparatus as described in claim 5, wherein said light-emitting assembly also includes a power cord being connected to said at least one light socket member for energizing said at least one light-emitting member, said power cord being disposed through said at least one elongate support member.

7. A change saver lamp apparatus as described in claim 5, wherein said light-emitting assembly further includes at least one light shade member being removably disposed upon said at least one light socket member.

8. A change saver lamp apparatus as described in claim 1, wherein said base assembly includes an ornamental structure being securely attached to said base member and including a football-shaped structure, a clock, a flowers-shaped structure, and a space ship structure.

9. A change saver lamp apparatus comprising:

a base assembly including a base member having a top side, a bottom side, and a plurality of slots disposed in said top side thereof, said base assembly including an ornamental structure being securely attached to said base member and including a football-shaped structure, a clock, a flowers-shaped structure, and a space ship structure;

a change-storing assembly including a plurality of elongate change-storing members each having a top end and a bottom end which is removably and securely disposed in said base member, each of said elongate change-storing members being a tubular member having a storage compartment therein, said storage compartment being adapted to store change, said tubular member being angled upwardly from said base member, said change-storing assembly also including a plurality of lids being removably disposed upon said top ends of said tubular members, each of said lids having a main wall and a slot being disposed through said main wall and being adapted to receive the change therethrough, said slots being adapted to receive said bottom ends of said elongate change-storing members;

at least one elongate support member having a top end and a bottom end which is securely disposed in said base member, said at least one elongate support member extending upwardly from said base member; and a light-emitting assembly including a light socket assembly being attached to said top end of said at least one elongate support member, and also including at least one light-emitting member being removably disposed in said light socket assembly, said light socket assembly further including at least one light socket member having a side wall and also includes at least on/off switch being movably and securely disposed in said side wall of said at least one light socket member, said light-emitting assembly also including a power cord being connected to said at least one light socket member for energizing said at least one light-emitting member, said power cord being disposed through said at least one elongate support member, said light-emitting assembly further including at least one light shade member being removably disposed upon said at least one light socket member.

10. A change saver lamp apparatus as described in claim 1, wherein said light socket assembly further includes at least one light socket member having a side wall and also includes at least on/off switch being movably disposed in said side wall of said at least one light socket member.

11. A change saver lamp apparatus as described in claim 5, wherein said light-emitting assembly also includes a power cord being connected to said light socket assembly for energizing said at least one light-emitting member.

12. A change saver lamp apparatus as described in claim 10, wherein said light-emitting assembly further includes at least one light shade member being removably disposed upon said at least one light socket member.

13. A change saver lamp apparatus as described in claim 1, wherein said base assembly includes an ornamental structure being securely attached to said base member and including a football-shaped structure, a clock, a flowers-shaped structure, and a space ship structure.

* * * * *